United States Patent [19]

DeLorenzo

[11] 4,343,837

[45] Aug. 10, 1982

[54] TIPPER FOR EMBOSSED CARDS AND REMOVABLE CASSETTE FOR USE THEREWITH

[75] Inventor: Dana J. DeLorenzo, Brockton, Mass.

[73] Assignee: DBS, Inc., Randolph, Mass.

[21] Appl. No.: 134,499

[22] Filed: Mar. 27, 1980

[51] Int. Cl.[3] ..... B05D 5/00

[52] U.S. Cl. ..... 427/275; 118/44; 118/46; 118/202; 242/199; 400/207

[58] Field of Search ..... 242/200, 199, 197, 198; 400/207, 208, 208.1; 118/202, 211, 44, 46; 427/275, 256; 156/234; 101/27, 32, DIG. 4, 336

[56] References Cited

U.S. PATENT DOCUMENTS

| | | | |
|---|---|---|---|
| 2,005,404 | 6/1935 | Wittel | 242/200 |
| 2,621,435 | 12/1952 | Weber | 101/27 |
| 2,764,934 | 10/1956 | Kaplan | 101/336 X |
| 2,855,844 | 10/1958 | Stewart | 101/23 |
| 2,973,853 | 3/1961 | Freedson . | |
| 2,997,016 | 8/1961 | Gushue | 101/27 X |
| 3,151,724 | 10/1964 | Ross et al. | 400/208.1 |
| 3,198,168 | 8/1965 | Grupe | 101/336 X |
| 3,349,887 | 10/1967 | Goff, Jr. | 400/208 |
| 3,695,160 | 10/1972 | Stockdale | 242/197 X |
| 3,701,495 | 10/1972 | Holliday | 242/199 X |
| 3,905,465 | 9/1975 | Frechette et al. | 400/208 X |
| 4,029,010 | 6/1977 | Deisting | 101/316 |
| 4,033,445 | 7/1977 | Oddicini | 400/208 |
| 4,136,614 | 1/1979 | Wuthrich | 101/336 X |

FOREIGN PATENT DOCUMENTS

| | | | |
|---|---|---|---|
| 1282276 | 7/1972 | United Kingdom | 242/200 |
| 1455915 | 11/1976 | United Kingdom | 400/208 |

*Primary Examiner*—Clifford D. Crowder
*Attorney, Agent, or Firm*—Gerald J. Ferguson, Jr.; Joseph J. Baker

[57] ABSTRACT

An improvement in a device for tipping an embossed workpiece, such as a credit card, the device being of the type having a frame supporting a stationary bed for receiving the workpiece and a heated platen reciprocally driven through a cycle toward and away from the bed in response to insertion of the workpiece. The improvement comprises a removably mounted holder containing a ribbon having a treated surface thereon, the ribbon extends unsupported a distance between a supply spool and a driven takeup spool mounted within the holder. Only the unsupported portion of the ribbon is positioned intermediate the platen and stationary bed when the holder is in place and is forced into engagement with the workpiece during movement of the platen toward the stationary bed.

18 Claims, 9 Drawing Figures

FIG. 4
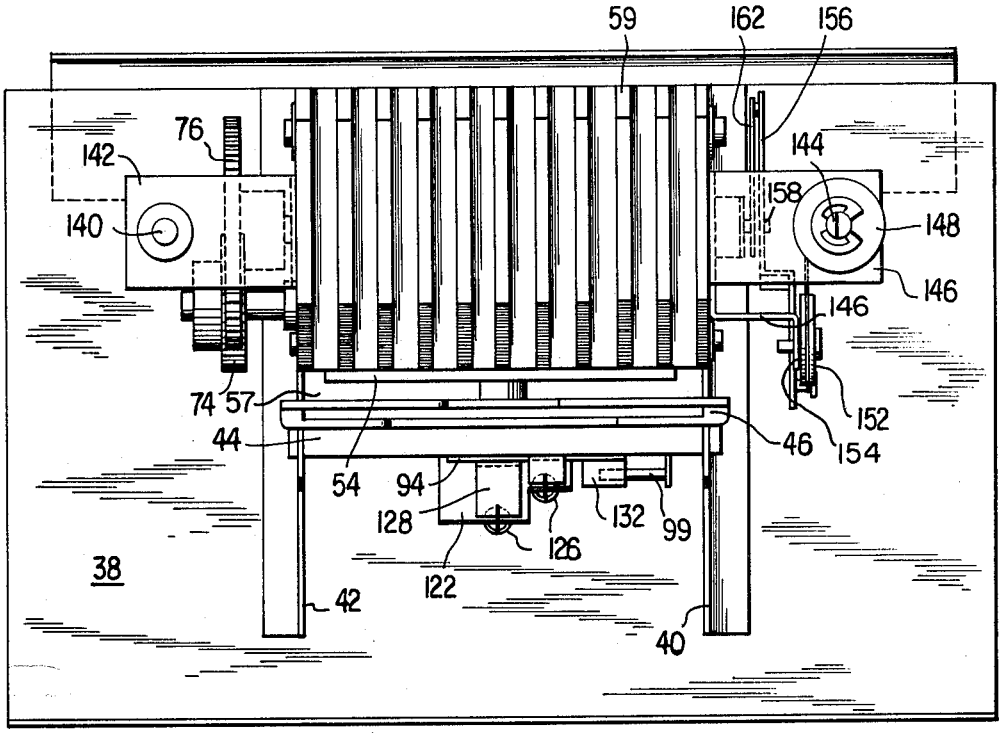
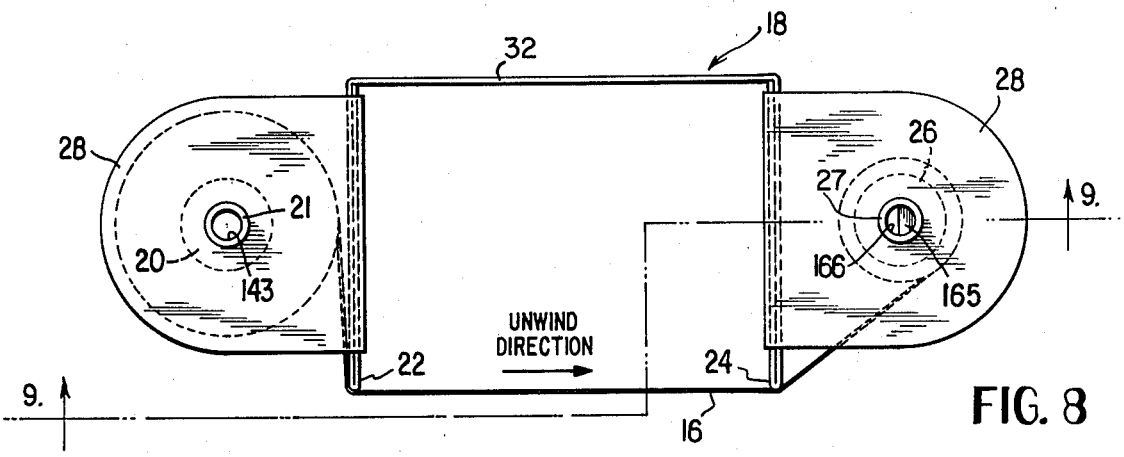
FIG. 8
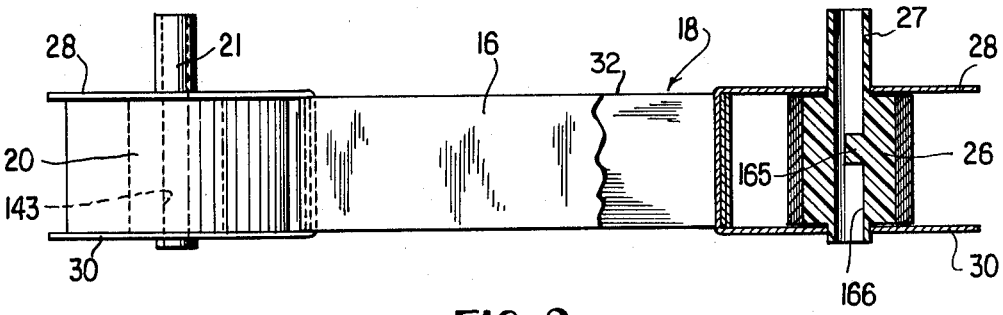
FIG. 9

TIPPER FOR EMBOSSED CARDS AND REMOVABLE CASSETTE FOR USE THEREWITH

BACKGROUND OF THE INVENTION

This invention relates to tipping devices for embossed workpieces and more specifically to a novel and useful removably mounted cassette therefor containing a ribbon treated with pigmented tipping material.

Applicant is unaware of any tipping device incorporating the removable ribbon carrying cassette of the present invention. The prior art structure in this area of which applicant is aware is exemplified, for example, in U.S. Pat. No. 2,997,016 which discloses a tipping device for an embossed workpiece, such as a conventional plastic credit card. The device has a supply spool on which is wound a ribbon treated with pigmented tipping material. The ribbon extends between a platen and bed and around idler, guide and clamping rollers to a takeup spool. The principle drawback to this structure is that the ribbon must be manually positioned in a circuitous path through the device around the aforementioned rollers to a takeup spool each time the supply of ribbon is exhausted. This manual positioning of the ribbon is not only time consuming and disruptive of normal operation of the device, it requires knowledge of the precise path of the ribbon and a relatively high degree of dexterity to position it.

The present invention overcomes the aforementioned disadvantages of the prior art by providing a tipping device wherein the ribbon treated with pigmented tipping material is held in a frame in the form of a cassette. The ribbon extends unsupported a distance from a supply spool to a driven takeup spool. A fixed spindle is mounted on one side of a passageway extending between a support against which the workpiece is placed and a reciprocally driven heated platen, and a driven spindle is mounted on the other side of the passageway. To load the device, the cassette is merely positioned on the spindles such that only the unsupported portion of the ribbon extends through the aforementioned passageway. When the supply of unused ribbon is exhausted, the cassette is merely removed from the spindles and discarded and a new cassette inserted on the spindles as previously described. The design of the cassette and the relative position of the spindles ensure that the cassette cannot be improperly installed by an unskilled operator.

It is therefore the primary object of the present invention to provide a superior means of loading and unloading a tipping device for embossed workpieces such as credit cards.

It is another object of the present invention to provide a self-contained supply of treated ribbon in the form of a cassette for a tipping device.

It is yet another object of the present invention to provide a cassette for a tipping device, which because a portion of the ribbon extending between spools in the cassette in unsupported, only the unsupported portion need be placed between the platen and bed, thus resulting in a more compact device.

It is a further object of the present invention to provide a cassette containing treated ribbon for a tipping device which can be easily and accurately positioned in the top of the device and which can be easily removed and discarded when exhausted.

It is a still further object of the present invention to provide a tipping device with cassette loading of the ribbon which is simple in construction and which can be operated easily and efficiently by an unskilled person.

These together with other objects and advantages which will become subsequently apparent reside in the details of construction and operation as more fully hereinafter described and claimed, reference being made to the accompanying drawings forming a part hereof, wherein like characters of reference refer to like parts throughout, and in which:

FIG. 4 is a plan view of the device;

FIG. 8 is an enlarged plan view of the cassette of the present invention; and FIG. 9 is a partial cross-sectional view of the cassette taken along lines 9—9 of FIG. 8.

DETAILED DESCRIPTION OF INVENTION

Figure 1:
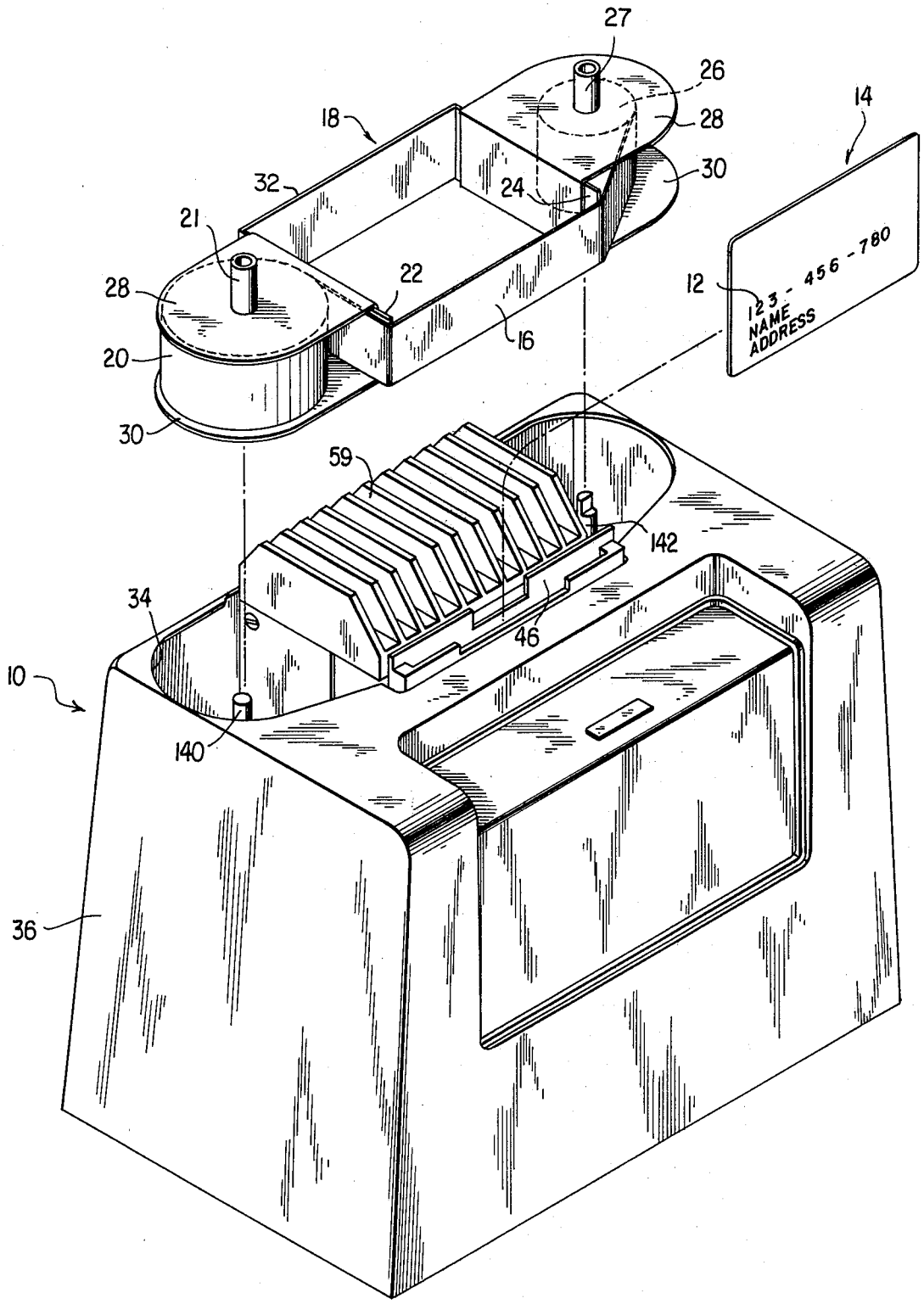
FIG. 1 is a perspective view of the tipping device for embossed cards and associated ribbon carrying cassette comprising the present invention.
Figure 2:
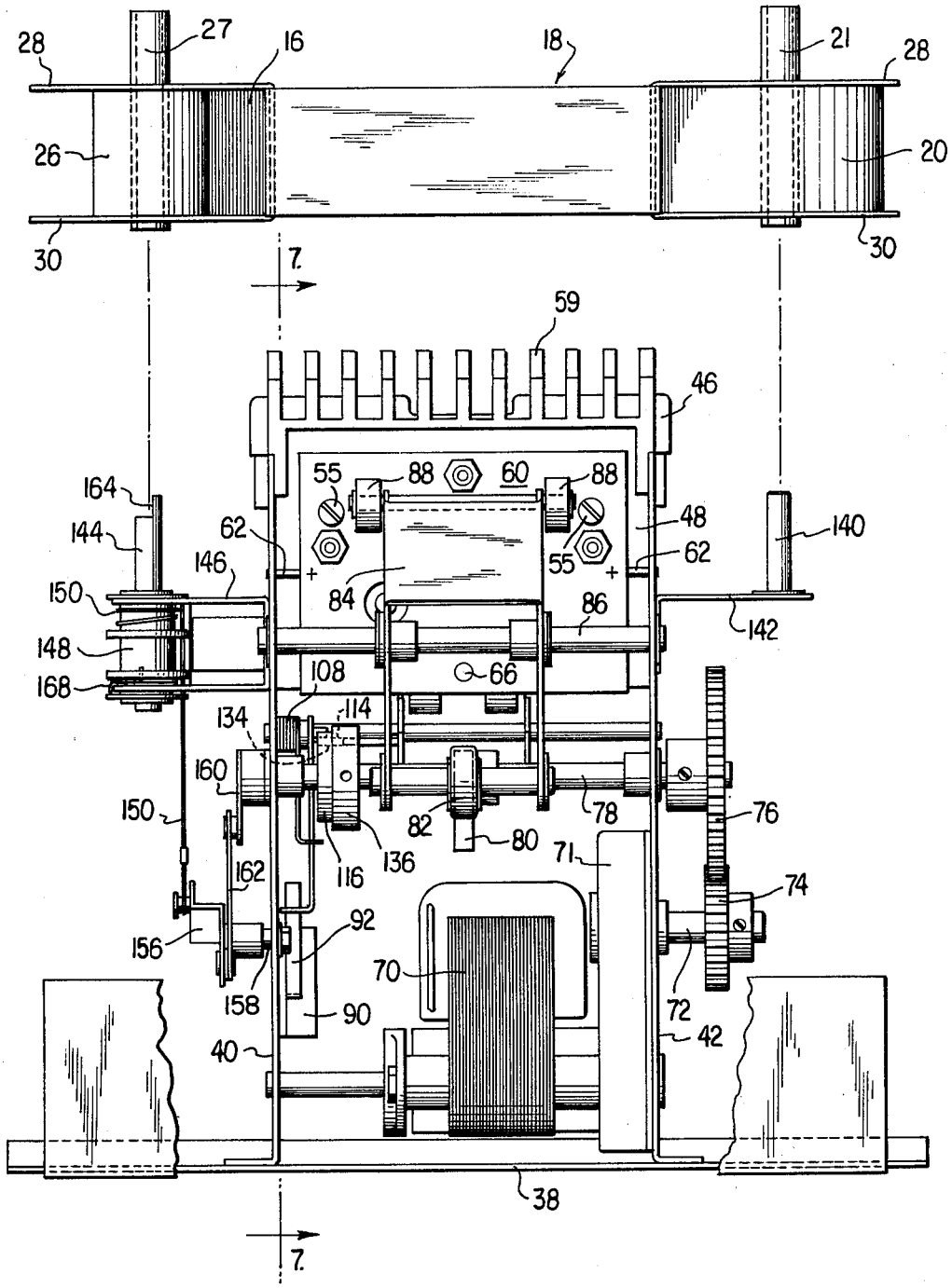
FIG. 2 is an elevational view of the back of the device of the present invention with the cover removed.
Figure 3:
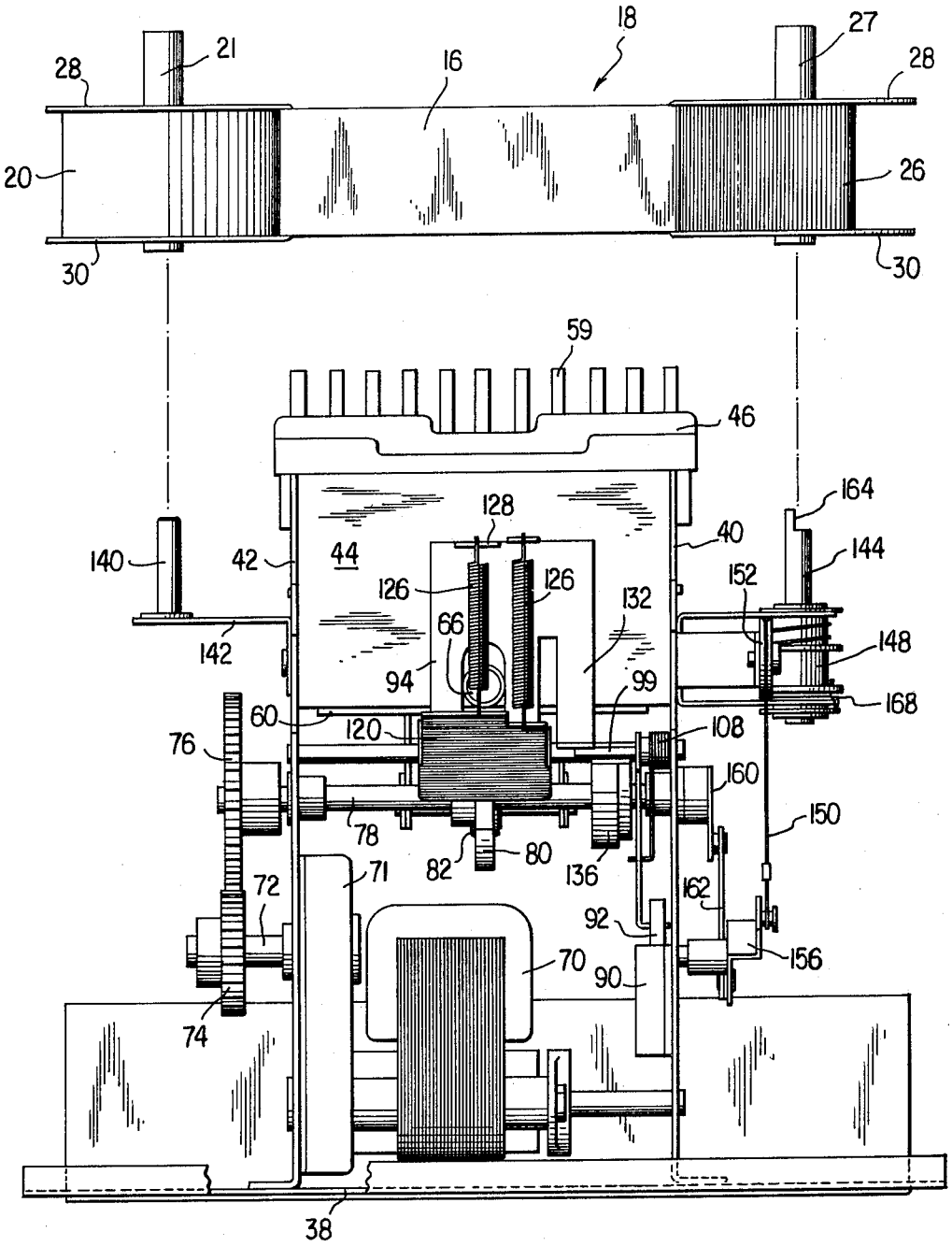
FIG. 3 is an elevational view of the front of the device.
Figure 6:
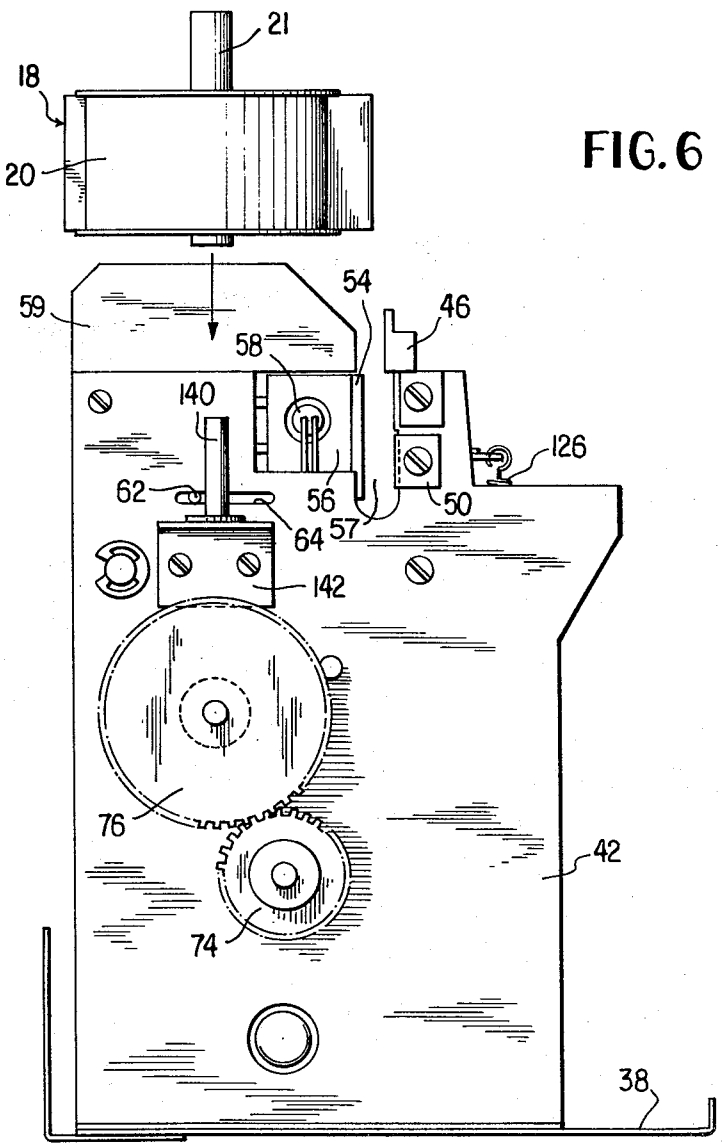
FIG. 6 is an elevational view from the other side of the device.
Figure 5:
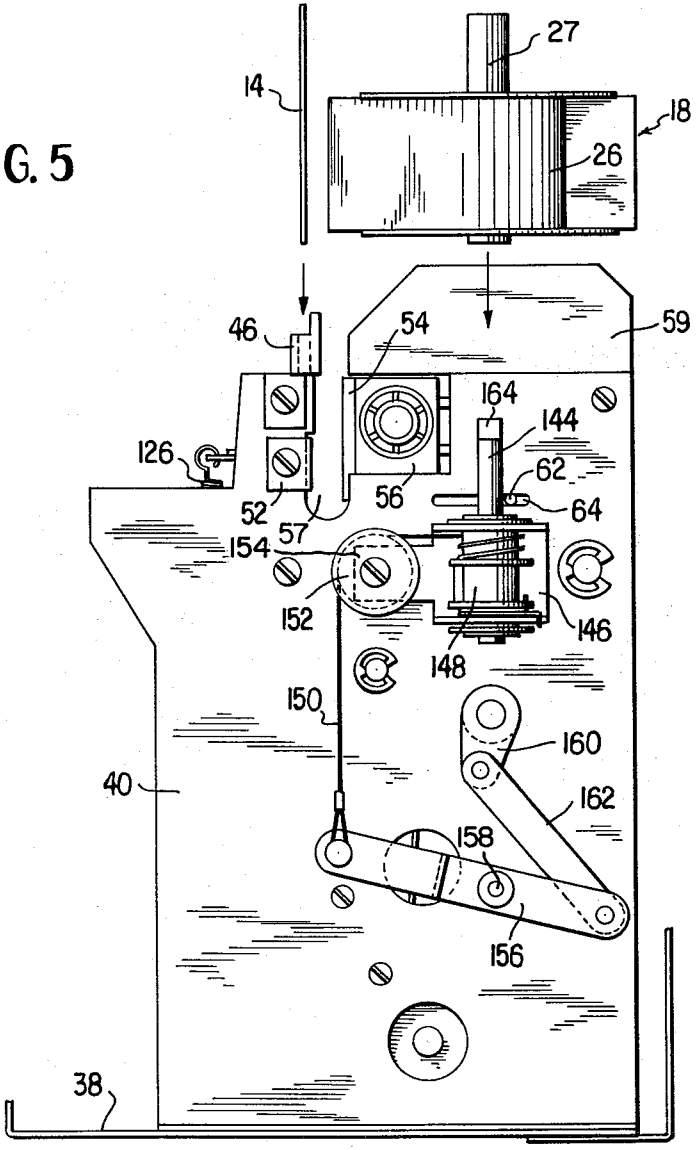
FIG. 5 is an elevational view from one of the sides of the device.
Figure 7:
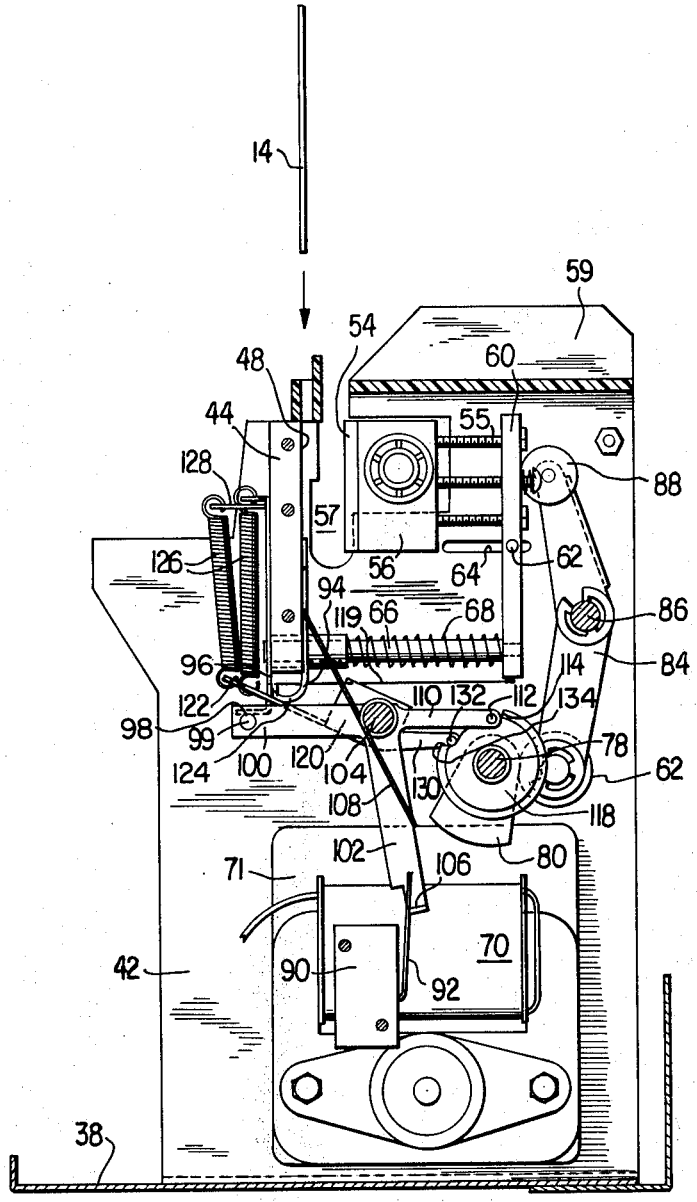
FIG. 7 is a cross-sectional view of the device taken along the lines 7—7 of FIG. 2.

Referring to the Figures and more particularly to FIGS. 1, 7 and 8 thereof, a device 10 is shown adapted to apply a distinctive color facing to the relief faces 12 of characters of the embossed type often associated with a workpiece in the form of a printing plate 14 such as, for example, a conventional credit card. The cards 14 are typically made of a thermoplastic material capable of being shaped in an embossing machine to produce the relief faces 12. Because the thermoplastic material is composed of a specific background color, often white, it is often necessary to tip the tops of the relief faces 12 to improve visual recognition. Such tipping is accomplished, as well be described in more detail hereinafter, by uniformly and simultaneously engaging the relief faces 12 with the treated side of a heated strip of ribbon-like material 16 having a pigmented coating held in a disposable cassette 18 removably mounted in the top of the device 10. The pigmented coating is thus transferred by heat and pressure to the relief faces 12 to thereby render the embossed characters more visually recognizable. It is to be understood, of course, that any type of card having an embossed surface can be made more visually distinct by utilizing the machine herein described.

The strip of ribboned material 16 is wound on a supply spool 20 and extends around first guide 22 an unsupported distance to a second guide 24 and from there to a takeup spool 26. The supply and takeup spools 20,26, respectively, are rotatably mounted between parallel sides 28,30 of a frame 32 forming the cassette 18. The supply spool 20 and the takeup spool 26 have knobs 21,27, respectively, which extend a distance above sides 28 which enable the spools 20,26 to be manually rotated to remove slack in the ribbon 16 after the cassette 18 is in position within opening 34 of cover 36 as will be more fully described later with regard to the description of the operation of the entire device.

Referring now to FIGS. 2 to 6, the tipping device 10 is shown with the cover 36 of FIG. 1 removed and comprises a base plate 38 on which are secured parallel vertical side frame members 40,42. A stationary bed 44 is provided mounted between frame members 40,42 for supporting the embossed printing plate 14 during the tipping operation. Also secured to frame members 40,42 above the stationary bed 44 is a chute 46 having a longitudinally extending slot formed therethrough in alignment with the face 48 of the stationary bed 44. Separate guide plates 50,52 are attached to frame members 40,42 and have a portion thereof spaced from the face 48 to ensure that the inserted printing plate 14 remains in a position parallel to and substantially against the face 48 during the entire tipping operation.

A platen 54 made of heat resistant elastomeric material is secured to the face of a platen block 56 opposite to and spaced apart a distance from the face 48 of the stationary bed 44. This spaced apart distance and the length and height of stationary bed 44 substantially define a ribbon receiving slot 57. The platen block 56 has a longitudinally extending heating cartridge 58 positioned therein for heating the platen 54 and subsequently the ribboned material 16 during each operation of the device. A finned heat sink 59 is provided above the platen block 56 to dissipate heat generated thereby during operation of the device. The platen block 56 is secured by screws 55 to a spaced-apart plate 60 which is mounted for reciprocal movement between the frame members 40,42 by means of pins 62 secured to opposite sides of the plate 60. The pins 62 slide in slots 64 formed in frame members 40,42 to thereby permit the plate 60 and attached platen block 56 to move toward and away from the stationary bed 44. A shaft 66 is also provided secured at one end to the stationary bed 44 through the mounting plate 60 to guide same and prevent any pivoting of the plate 60 about the pins 62. A compression spring 68 is positioned over the shaft 64 to bias the mounting plate 60 and attached platen block 56 and platen 54 away from the stationary bed 44.

In order to drive the platen 54 toward and away from the stationary bed 44 in reciprocal fashion, an electric motor 70 is provided which is mounted to the base plate 38. The motor 70 is connected to a reduction gear box 71 having an output shaft 72. The output shaft 72 has a gear 74 connected thereto which in turn is in meshing engagement with a gear 76 secured to cam shaft 78 rotatably mounted between frame members 40,42. The cam shaft 78 has a cam 80 which engages a roller 82 secured to one end of a rocker arm 84. The rocker arm 84 is rotatably mounted on a pivot shaft 86 extending between frame members 40,42 and has spaced apart rollers 88 which engage the mounting plate 60. As can be seen, as the motor 70 rotates, the cam 80 will engage the roller 82 to rotate the rocker arm 84. Rotation of the rocker arm 84 causes rollers 88 to move the mounting plate 60, attached platen block 56 and platen 54 toward and away from the stationary bed 44.

The motor 70 is energized upon actuation of switch 90 when the switch arm 92 is permitted to move to the left as viewed in FIG. 7 which is accomplished upon insertion of the printing plate 14 in chute 46 as will now be described. Positioned adjacent the lower portion of face 48 of the stationary bed 44 is an anvil 94 which extends around and below the stationary bed 44. The anvil 94 has an L-shaped arm 96 secured thereto made of resilient metal. The arm 96 has a pawl 98 which engages a projection 99 on a first arm 100 of a detent linkage 102 pivotally mounted on a shaft 104 extending between frame members 40,42. A second arm 106 of the detent linkage 102 engages the switch arm 92. A coil spring 108 biases the detent linkage in a clockwise direction as viewed in FIG. 7. A third arm 110 of the detent linkage 102 has a projection 112 which engages a notch 114 on a first track 116 of a detent roller 118. The detent roller 116 is secured to cam shaft 78 and rotates therewith. A pawl release arm 119 is secured to the mounting plate 60 and extends to a position adjacent the L-shaped arm 96 to release the pawl 98 as will be more fully described later. Also provided is an ejector bracket 120 pivotally mounted on pivot shaft 86 with one section 122 thereof biased into engagement with the curved portion 124 of the anvil 94 by means of tension springs 126 connected at one of their ends to section 122 and their other end to a bracket 128 mounted on the stationary bed 44. The other section 130 of the ejector bracket 120 has a projection 132 thereon which engages a notch 134 in a second track 136 on the detent roller 118. The function of the detent linkage 102 is to first close switch 90 upon downward pressure exerted on the anvil 94 by printing card 14 to energize motor 70 and also keep switch 90 closed during one complete revolution of cam 80. The function of ejector bracket 120 is to provide a snap force to the printing plate 14 at the end of one complete revolution of the cam 80 to thereby eject the printing plate 14 a distance upward and out of chute 46. A more detailed description of the function of each of the components of the tipping device will be set forth later when the complete operation is described.

The cassette 18 is removably mounted on the tipping device 10 on a fixed spindle 140 held by a bracket 142 secured to frame member 42. The spindle 140 fits within a recess 141 in the supply spool 20. A drive spindle 144 is rotatably mounted on a bracket 146 secured to frame member 40. The drive spindle 144 has a drive drum 148 containing a one-way clutch (not shown) which can be, for example, a roller clutch manufactured by The Torrington Company. A cable 150 is wound around and secured at one end to the drive drum 148 and extends over an idler pulley 152 rotatably mounted on an extension 154 of bracket 146. The other end of the cable 150 is connected to idler arm 156 mounted for rotation on a shaft 158 also secured to frame member 40. The idler arm 156 is then connected to a crank 160 via lever arm 162. The cable 150 is maintained taut by means of spring 168. The crank 160 is fixed to an extension of the cam shaft 78 extending through the frame member 40. The drive spindle 144 has a notch 164 on the end thereof which engages a projection 165 in recess 166 of the takeup spool 26. When the cassette 18 is in its proper position on the spindles 140,144, only the unsupported portion of the treated ribbon 16 extends between the platen 54 and the stationary bed 44. As the camshaft 78 starts to rotate and before the cam 80 engages roller 82 to move the platen 54, a one-half revolution of the crank 160 causes the drive spindle 144 to rotate, by means of the one-way clutch in drive drum 148, cable 150, idler arm 156 and lever arm 162, an incremental distance. The cable 150 is rewound on the clutch 148 by means of a coil spring 168 during the remaining one-half revolution of the crank 160. Rotation of the drive spindle 144 causes the takeup spool 26 to pull a fresh or unused section of ribbon 16 into tipping position between the platen 54 and stationary bed 44 for each revolution of the cam shaft 78.

OPERATION

Prior to operating the tipping device 10, a cassette 18 of treated ribbon is inserted on the spindles 140,144 such that only the unsupported portion of the ribbon 16 extends between the platen 54 and stationary bed 44. The knobs 21, 27 are then rotated to take slack out of the ribbon and ensure that the notch 164 is in driving engagement with projection 165. The platen 54 is then permitted to attain proper temperature—usually within a few minutes.

A printing plate 14 is then inserted in chute 46 with the relief faces 12 facing platen 54. Continued downward movement of the printing plate 14 against anvil 94 simultaneously causes the detent linkage 102 to rotate which in turn starts motor 70 and lifts projection 112 from notch 114 on detent roller 118 and causes ejector bracket 110 to rotate lifting projection 132 from notch 134 on detent roller 118. As cam 80 rotates to thereby move rocker arm 84, the mounting plate 60 causes the platen 54 to move toward the ribbon 16 forcing it into engagement with the relief faces 12 of the printing plate 14. During a first dwell period of cam 80, i.e. cam surface furthest from the axis of rotation of the cam, the platen 54 heats the ribbon thereby tipping or transferring the pigmented material of which the ribbon is coated to said relief faces. Also simultaneous with the advance of the platen 54 toward the stationary bed 44, the pawl release arm 119 engages anvil arm 96 forcing pawl 98 clear of projection 99 thereby ensuring that only one reciprocal movement of the platen 54 results even through the operator of the device continues to hold the anvil 94 at its lowermost point by pressure exerted thereon by the printing plate 14 and an unused section of ribbon 16 is brought into position in front of the platen 54 by rotation of crank 160 and associated movement of drive spindle 144.

As the cam 80 continues its rotation past the first dwell period to the second dwell period, i.e. cam surface closest to the axis of rotation of the cam, the projections 112,132 remain in engagement with the curved portion 124 of the detent roller 118 to ensure continued energization of the motor 70 and the return of the platen 54 to its starting position. When the second dwell period of the cam 80 aforementioned is reached, the projections 112,132 are permitted to drop into their respective notches 114,134 resulting in a pivoting of detent linkage 102 thereby actuating switch 90 to stop the motor 70 and a rapid pivoting of ejector bracket 120 into engagement with anvil 94 thereby ejecting the tipped printing plate 14 to a position for easy manual removal thereof from chute 46. The tipping device 10 is then ready for insertion and tipping of another printing plate.

The foregoing is considered as illustrative only of the principles of the invention. Further, since numerous modifications and changes will readily occur to those skilled in the art, it is not desired to limit the invention to the exact construction shown and described, and accordingly, all suitable modifications and equivalents may be resorted to, falling within the scope of the invention.

What is claimed is:

1. An improvement in a device for tipping the relief faces on an embossed printing plate, such as a credit card, with pigmented material, said device being of the type having a frame supporting a stationary bed for receiving said printing plate adjacent thereto and a heated platen reciprocally driven between spaced-apart portions of said support frame through a cycle toward and away from said bed in response to insertion of said printing plate adjacent said bed, said improvement comprising:

(a) a cassette containing a ribbon treated with said pigmented material, a portion of said ribbon extending an unsupported distance between a supply spool of said ribbon and a takeup spool for said ribbon, said cassette having a mounting frame for said supply spool and said takeup spool, said mounting frame defining an opening for straddling said spaced-apart portions of said support frame when said unsupported portion of said ribbon is positioned intermediate said platen and said bed to provide a more compact device, and (b) means secured to said housing adjacent said platen for removably mounting said cassette such that upon engagement of said treated ribbon with said relief faces of said printing plate by movement of said heated platen, said pigmented material is transferred to said relief faces.

2. The improvement as set forth in claim 1 wherein said means for supporting said cassette is a pair of oppositely disposed spindles.

3. The improvement as set forth in claim 2 wherein means is provided for rotating one of said spindles an incremental distance during said reciprocation of said platen and said takeup spool is driven by said rotating spindle.

4. The improvement as set forth in claim 3 wherein each of said spools has a recess formed in the center thereof adapted to receive one of said spindles, said recess in said takeup spool further having a projection formed therein for receiving, in driving engagement, a corresponding notch formed in said rotating spindle.

5. The improvement as set forth in claim 1 wherein each of said spools has a knob for manually moving said ribbon between said spools.

6. The improvement as set forth in claim 1 wherein said cassette is so constructed that only said unsupported portion of said ribbon extends between said platen and said bed thereby resulting in a more compact device.

7. The improvement as set forth in claim 1 wherein said opening, when bounded by said unsupported portion of said ribbon, is rectangular in shape.

8. The improvement as set forth in claim 1 wherein said mounting frame has a central portion and two end portions, each of said end portions having parallel, spaced-apart sides, one of said end portions having said supply spool mounted between said sides thereof and the other of said end portions having said takeup spool mounted between said sides thereof.

9. The improvement as set forth in claim 8 wherein knobs are provided on said supply and said takeup spools to enable them to be manually rotated.

10. A method of loading a device for tipping embossed workpieces with pigmentation from a treated ribbon, and tipping device being of the type having a frame supporting a stationary bed for receiving said workpiece, a heated platen spaced from said stationary bed between spaced-apart portions of said support frame and reciprocally driven through a cycle toward and away from said stationary bed in response to insertion of said workpiece adjacent thereto, a fixed spindle secured to said frame adjacent one side of said platen and a driven spindle secured to said frame adjacent the other side, said method comprising the steps of:

(a) providing a holder wherein said treated ribbon is wound on a supply spool and a portion of said treated ribbon extends an unsupported distance to a takeup spool, said holder having a mounting frame for said supply spool and said takeup spool, said mounting frame defining an opening for straddling said spaced-apart portions of said support frame, and (b) positioning said supply spool and said takeup spool on said fixed and said drive spindle respectively such that said unsupported portion of said treated ribbon extends between said platen and said stationary bed.

11. A device for tipping the relief faces on an embossed printing plate, such as a credit card, with pigmented material comprising:

(a) a frame having a ribbon receiving slot in a side thereof and for supporting a stationary bed for receiving said printing plate adjacent thereto, (b) a heated platen reciprocally driven through a cycle between spaced-apart portions of said support frame toward and away from said bed in response to insertion of said printing plate adjacent said bed, and (c) a pair of spindles disposed at the ends of said ribbon receiving slot adapted to receive a removable cassette containing a ribbon treated with said pigmented material so that a portion of said ribbon extends through said ribbon receiving slot, said cassette having a mounting frame for said supply spool and said takeup spool, said mounting frame defining an opening for straddling said spaced-apart portions of said support frame when said ribbon is positioned between said heated platen and said bed whereby upon engagement of said ribbon with said relief faces of said printing plate by movement of said heated platen, said pigmented material is transferred to said relief faces.

12. A printing device as set forth in claim 11 wherein a portion of said ribbon extends an unsupported distance between a supply spool of said ribbon and a takeup spool for said ribbon, said unsupported portion being positioned intermediate said platen and said bed.

13. A printing device as set forth in claim 12 wherein means is provided for rotating one of said spindles an incremental distance during reciprocation of said platen and said takeup spool is driven by said rotating spindle.

14. The improvement as set forth in claim 13 wherein each of said spools has a recess formed in the center thereof adapted to receive one of said spindles, said recess in said takeup spool further having a projection formed therein for receiving, in driving engagement, a corresponding notch formed in said rotating spindle.

15. The improvement as set forth in claim 12 wherein each of said spools has a knob for manually moving said ribbon between said spools.

16. The improvement as set forth in claim 12 wherein said cassette is so constructed that only said unsupported portion of said ribbon extends between said platen and said bed thereby resulting in a more compact device.

17. A cassette for use in a device for tipping the relief faces on an embossed printing plate, such as a credit card, with pigmented material wherein said device has a heated platen mounted within a support frame which platen is reciprocally driven through a cycle toward and away from a stationary bed, said cassette comprising:

(a) a ribbon treated with said pigmented material having a portion thereof extending an unsupported distance between a supply spool of said ribbon and a takeup spool for said ribbon, and (b) a frame for rotatably mounting said supply spool and said takeup spool in spaced-apart relationship to each other, said mounting frame and said unsupported portion of said ribbon defining an opening for receiving said support frame when said unsupported portion of said ribbon is positioned between said platen and said stationary bed.

18. The cassette as set forth in claim 17 wherein said mounting frame has a central portion and two end portions, each of said end portions having parallel, spaced-apart sides, one of said end portions having said supply spool mounted between said sides thereof and the other of said end portions having said takeup spool mounted between said sides thereof.

* * * * *